US011489265B2

(12) United States Patent
Chang et al.

(10) Patent No.: US 11,489,265 B2
(45) Date of Patent: Nov. 1, 2022

(54) RECONFIGURABLE WIDEBAND PHASE-SWITCHED SCREEN BASED ON ARTIFICIAL MAGNETIC CONDUCTOR

(71) Applicant: Nanjing University of Posts and Telecommunications, Jiangsu (CN)

(72) Inventors: Yumei Chang, Jiangsu (CN); Lin Wang, Jiangsu (CN); Bo Li, Jiangsu (CN); Yaming Bo, Jiangsu (CN); Lei Zhu, Jiangsu (CN)

(73) Assignee: NANJING UNIVERSITY OF POSTS AND TELECOMMUNICATIONS

( * ) Notice: Subject to any disclaimer, the term of this patent is extended or adjusted under 35 U.S.C. 154(b) by 266 days.

(21) Appl. No.: 16/925,447

(22) Filed: Jul. 10, 2020

(65) Prior Publication Data

US 2021/0013617 A1 Jan. 14, 2021
US 2021/0320422 A9 Oct. 14, 2021

(30) Foreign Application Priority Data

Jul. 11, 2019 (CN) ..... 201910622305.9

(51) Int. Cl.
*H01Q 15/00* (2006.01)

(52) U.S. Cl.
CPC ..... *H01Q 15/002* (2013.01); *H01Q 15/0046* (2013.01)

(58) Field of Classification Search
CPC ..... H01Q 15/0066; H01Q 15/008; H01Q 15/002; H01Q 15/0086; H01Q 1/38;
(Continued)

(56) References Cited

U.S. PATENT DOCUMENTS 6,483,480 B1 * 11/2002 Sievenpiper ..... H01Q 15/008 343/754
8,816,921 B2 * 8/2014 Ayatollahi ..... H01Q 1/243 343/702

(Continued)

FOREIGN PATENT DOCUMENTS

CN 110034390 A * 7/2019
CN 110463666 11/2019

OTHER PUBLICATIONS

Li, T., Yang, H., Li, Q., Zhu, X., Cao, X., Gao, J. and Wu, Z. (2019), Dual-polarised and ultra-thin broadband AAMCs for both P and L bands applications. IET Microw. Antennas Propag., 13: 185-189. https://doi.org/10.1049/iet-map.2018.5151 (Year: 2019).*

(Continued)

*Primary Examiner* — Dameon E Levi
*Assistant Examiner* — Leah Rosenberg
(74) *Attorney, Agent, or Firm* — Onello & Mello, LLP

(57) ABSTRACT

The present invention discloses a reconfigurable wideband phase-switched screen (PSS) based on an artificial magnetic conductor (AMC). Gap capacitance between patches is controlled by changing the capacitance of varactors, so that periodic units have a plurality of continuous frequency points. A phase difference between two adjacent frequency bands is 143°-217°, so that the periodic structure absorbs incident electromagnetic waves in a wide frequency band, and the broadband PSS is implemented with a relative bandwidth of 45.2%. The AMC structure according to the present invention is simple in structure and easy to process, with a thickness less than one twentieth of the working wavelength, and greatly reduces size and costs.

9 Claims, 4 Drawing Sheets

(58) Field of Classification Search
CPC .... H01Q 13/28; H01Q 3/443; H01Q 15/0006; H01Q 15/14; H01Q 15/148; H01Q 3/44; H01Q 13/20; H01Q 19/10
See application file for complete search history.

(56) References Cited

U.S. PATENT DOCUMENTS

| | | | | |
|---|---|---|---|---|
| 9,774,082 | B2 * | 9/2017 | Piazza | H01Q 3/446 |
| 2002/0167456 | A1 * | 11/2002 | McKinzie, III | H01Q 3/46 343/756 |
| 2012/0098628 | A1 * | 4/2012 | Batchelor | H01Q 15/0066 333/24 C |

OTHER PUBLICATIONS

Paquay, et al. "Thin AMO Structure for Radar Cross-Section Reduction", IEEE Transactions on Antennas and Propagation, vol. 55, No. 12 (Dec. 2007) pp. 3630-3638.

* cited by examiner

RECONFIGURABLE WIDEBAND PHASE-SWITCHED SCREEN BASED ON ARTIFICIAL MAGNETIC CONDUCTOR

CROSS REFERENCE TO RELATED APPLICATIONS

The present application claims the benefit of priority under 35 USC 119 to Chinese patent application 201910622305.9, filed Jul. 11, 2019, the contents of which are incorporated herein by reference.

TECHNICAL FIELD

The present invention belongs to the technical field of microwave circuits, and particularly relates to a reconfigurable wideband phase-switched screen (PSS) based on an artificial magnetic conductor (AMC).

BACKGROUND

A radar cross section (RCS) is a physical quantity of an echo intensity generated by a target under the irradiation of radar waves. A radar absorbing material (RAM) is widely used. The RAM converts electromagnetic wave energy into electric energy, thus reducing energy reflection to meet the requirement for stealth. The working principle of the PSS is different from that of other RAMs. The PSS can shift the energy frequency of incident electromagnetic waves, so that reflected signals fall beyond the bandpass range of a radar receiver, thus reducing the reflectivity. A conventional PSS is composed of a metal plate, a quarter-wavelength dielectric barrier and a periodic patch array, with a large thickness.

The AMC, as a metamaterial, has the electromagnetic characteristics of in-phase reflection of plane waves in a specific frequency range, which can effectively address the thickness problem, and thus the AMC becomes a novel absorbing material. In 2007, Paquay et al., applied an AMC to the reduction of an RCS of a target. The AMC and a PEC were distributed in a checkerboard form, and the reflection phase difference between the two was 180°, so that electromagnetic waves could cancel each other with equal amplitude at the interface of the AMC and the PEC, thus achieving the goal of reducing the RCS of the target. The reconfigurable PSS can be implemented by using active devices. By controlling the capacitance value of a varactor, multiple continuous in-phase reflection points can be generated, thus changing the surface impedance of the AMC. Through the adjustability of the varactor, the surface impedance of the AMC at a certain frequency point f is switched between $R_1 \rightarrow \infty\Omega$ and $R_2 \rightarrow \infty 0\Omega$, so that a reflection coefficient is switched between $\rho_1 \rightarrow 1$ and $\rho_2 \rightarrow -1$. Therefore, a reflection coefficient $\Gamma$ of the PSS in a period T is 0 and the electromagnetic waves are perfectly absorbed at this frequency point f.

$$\Gamma = \frac{1}{T}(\tau\rho_1 + (T-\tau)\rho_2) = 0$$

SUMMARY

In view of the above problems, the present invention provides a reconfigurable wideband PSS based on an AMC, which can be used to absorb incident electromagnetic waves.

In order to implement the objective of the present invention, the technical solution adopted by the present invention includes an AMC, which is composed of a plurality of centrally symmetrical AMC units arranged in a two-dimensional periodic manner; the AMC unit includes an upper metal patch, a middle dielectric substrate, a lower metal ground, a varactor group and a capacitor group; the upper metal patch is composed of a central square metal patch, a first square ring metal patch and a second square ring metal patch and printed on the dielectric substrate, and a bottom surface of the dielectric substrate is provided with the metal ground; the square metal patch is connected to the first square ring metal patch by four varactors, the two square ring metal patches are connected by four capacitors, and both ends of the varactors and both ends of the capacitors are provided with metal patches; through a metalized through-hole in the central position of the unit, the central square metal patch is connected to the metal ground at the bottom surface of the dielectric substrate via the metalized through-hole, and the central square metal patches of units of periodically arranged AMCs are connected with each other; and the second square ring metal patches of units of periodically arranged AMCs are connected with each other.

Further, the varactor group is composed of a first varactor, a second varactor, a third varactor and a fourth varactor, which are welded on a right side, a lower side, a left side and an upper side between the square metal patch and the first square ring metal patch respectively; and the capacitor group is composed of a first capacitor, a second capacitor, a third capacitor and a fourth capacitor, which are welded on a right side, a lower side, a left side and an upper side between the first square ring metal patch and the second square ring metal patch respectively and are all positioned on the dielectric substrate.

Further, a sum of a length of the square metal patch vertically projected under the AMC unit, a length of the first square ring metal patch vertically projected under the AMC unit, a length of the second square ring metal patch vertically projected under the AMC unit, a length of the first varactor and a length of the third varactor, and lengths of both the first capacitor and the third capacitor is equal to a vertical projection length of the AMC unit.

Further, the perimeter of the square metal patch is $\lambda_{eff}/2$, where $\lambda_{eff}=\lambda_0(\varepsilon_r+1)\hat{}0.5$, and $\lambda_0$ is a wavelength of a free space.

Further, the dielectric substrate has a dielectric constant $\varepsilon_r$ of 2.2-10.2 and a thickness of $0.05*\lambda_g$, where $\lambda_g=\lambda_0/\varepsilon_r\hat{}0.5$, and $\lambda_0$ is a wavelength of a free space.

A reconfigurable wideband PSS based on an AMC is provided. The PSS is constructed on the basis of the AMC, capacitance of varactors on the AMC is controlled so that incident electromagnetic waves are respectively in an anti-phase reflection state and an in-phase reflection state at different frequencies, and the center frequency can be continuously switched to implement the broadband PSS.

Further, the position of an in-phase reflection point of the AMC is changed by controlling the capacitance of the varactor, so that a periodic unit has a plurality of continuous frequency points, and a phase difference between two adjacent frequency bands is 143°-217°, thereby realizing the effect of stealth to radar.

Compared with the prior art, the present invention has the following beneficial technical effects:

(1) By controlling the capacitance of the varactor, in-phase reflection can be realized at a plurality of continuous frequencies to implement the broadband PSS; moreover, frequency points can be freely switched, each frequency band can be effectively controlled to achieve the stealth effect, and the adjustability is strong.

(2) The total thickness of the dielectric substrate is about one twentieth of the working wavelength, and is 80% lower than that of the conventional PSS.

In one aspect, the present invention relates to a an artificial magnetic conductor (AMC), comprising: a plurality of centrally symmetrical AMC units arranged in a two-dimensional periodic manner, wherein an AMC unit of the plurality of centrally symmetrical AMC units comprises an upper metal patch; a dielectric substrate; a metal ground; a varactor group; and a capacitor group, wherein the upper metal patch comprises: a central square metal patch; a first square ring metal patch; and a second square ring metal patch, wherein: at least a portion of the upper metal patch is printed on the dielectric substrate and a bottom surface of the dielectric substrate is provided with the metal ground; the central square metal patch is connected to the first square ring metal patch by four varactors of the varactor group; the two square ring metal patches are connected by four capacitors of the capacitor group; and both ends of the four varactors and both ends of the four capacitors are provided with metal patches with the same size as the packaging size, wherein the AMC unit further comprises: a metalized through-hole in a central position of the AMC unit, wherein: the central square metal patch is connected to the metal ground at the bottom surface of the dielectric substrate via the metalized through-hole; the central square metal patches of units of periodically arranged AMCs are connected with each other; and the second square ring metal patches of units of periodically arranged AMCs are connected with each other.

In some embodiments, the varactor group comprises: a first varactor coupled to a right side of the AMC unit between the central square metal patch and the first square ring metal patch; a second varactor coupled to a lower side of the AMC unit between the central square metal patch and the first square ring metal patch; a third varactor coupled to a left side of the AMC unit between the central square metal patch and the first square ring metal patch; and a fourth varactor coupled to an upper side of the AMC unit between the central square metal patch and the first square ring metal patch, wherein the first through fourth varactors are positioned on the dielectric substrate, and wherein the capacitor group comprises: a first capacitor coupled to a right side of the AMC unit between the first square ring metal square metal patch and the second square ring metal patch; a second capacitor coupled to a lower side of the AMC unit between the first square ring metal square metal patch and the second square ring metal patch; a third capacitor coupled to a left side of the AMC unit between the first square ring metal square metal patch and the second square ring metal patch; and a fourth capacitor coupled to an upper side of the AMC unit between the first square ring metal square metal patch and the second square ring metal patch, wherein the first through fourth capacitors are positioned on the dielectric substrate.

In some embodiments, a sum of a length of the central square metal patch vertically projected under the AMC unit, a length of the first square ring metal patch vertically projected under the AMC unit, a length of the second square ring metal patch vertically projected under the AMC unit, a length of the first varactor and a length of the third varactor, and lengths of both the first capacitor and the third capacitor is equal to a vertical projection length of the AMC unit.

In some embodiments, the perimeter of the central square metal patch is $\lambda_{eff}/2$, wherein $\lambda_{eff}=\lambda_0(\varepsilon_r+1)\hat{}0.5$, and $\lambda_0$ is a wavelength of a free space.

In some embodiments, the dielectric substrate has a dielectric constant $\varepsilon_r$ of 2.2-10.2 and a thickness of $0.05*\lambda_g$, wherein $\lambda_g=\lambda_0/\varepsilon_r\hat{}0.5$, and $\lambda_0$ is a wavelength of a free space.

In some embodiments, a reconfigurable wideband phase-switched screen (PSS) is constructed on the basis of the AMC, wherein a capacitance of varactors on the AMC is controlled so that incident electromagnetic waves are respectively in an anti-phase reflection state and an in-phase reflection state at different frequencies, and the center frequency is continuously switched to implement a broadband PSS of the reconfigurable wideband PSS.

In some embodiments, a position of an in-phase reflection point of the AMC is changed by controlling the capacitance of the varactor, so that a periodic unit has a plurality of continuous frequency points, and the phase difference between two adjacent frequency bands is 143°-217°, thereby realizing the effect of stealth to radar.

In another aspect, provided is a circuit, comprising: a plurality of centrally symmetrical artificial magnetic conductor (AMC) units arranged in a two-dimensional periodic manner, wherein an AMC unit of the plurality of AMC units comprises: an upper metal patch; a dielectric substrate; a metal ground; a varactor group; and a capacitor group, wherein the upper metal patch comprises: a central square metal patch; a first square ring metal patch; and a second square ring metal patch, wherein: at least a portion of the upper metal patch is printed on the dielectric substrate and a bottom surface of the dielectric substrate is provided with the metal ground.

In some embodiments, circuit of claim 8, further comprises a metalized through-hole in a central position of the AMC unit, wherein: the central square metal patch is connected to the metal ground at the bottom surface of the dielectric substrate via the metalized through-hole the central square metal patches of units of periodically arranged AMCs are connected with each other; and the second square ring metal patches of units of periodically arranged AMCs are connected with each other.

In some embodiments, the central square metal patch is connected to the first square ring metal patch by four varactors of the varactor group.

In some embodiments, the two square ring metal patches are connected by four capacitors of the capacitor group.

DETAILED DESCRIPTION

The following further describes the present invention in detail with reference to the accompanying drawings and examples.

Figure 1:
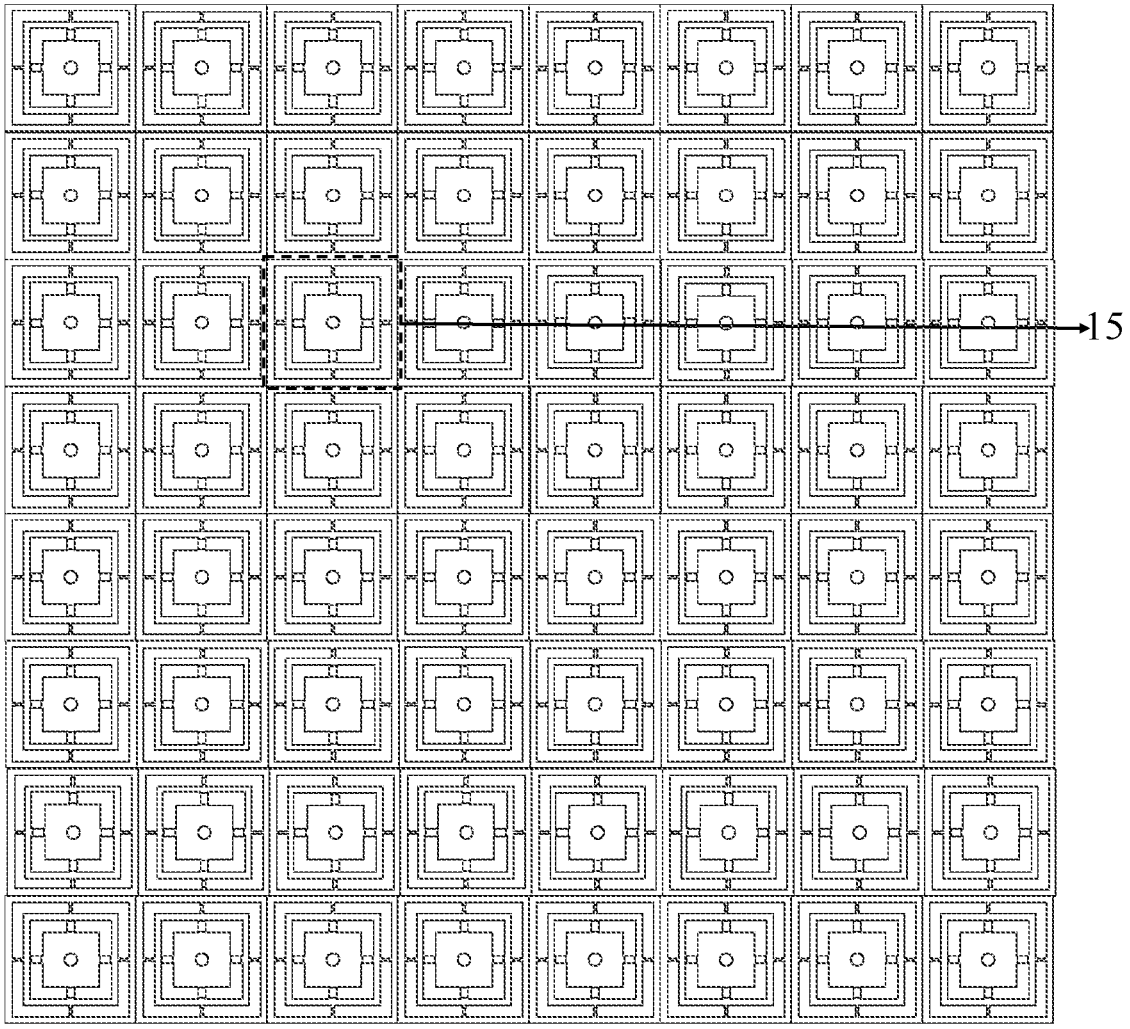
FIG. 1 is a schematic view of a periodic structure of a PSS including a plurality of AMC units according to embodiments of the present invention.
Figure 2:
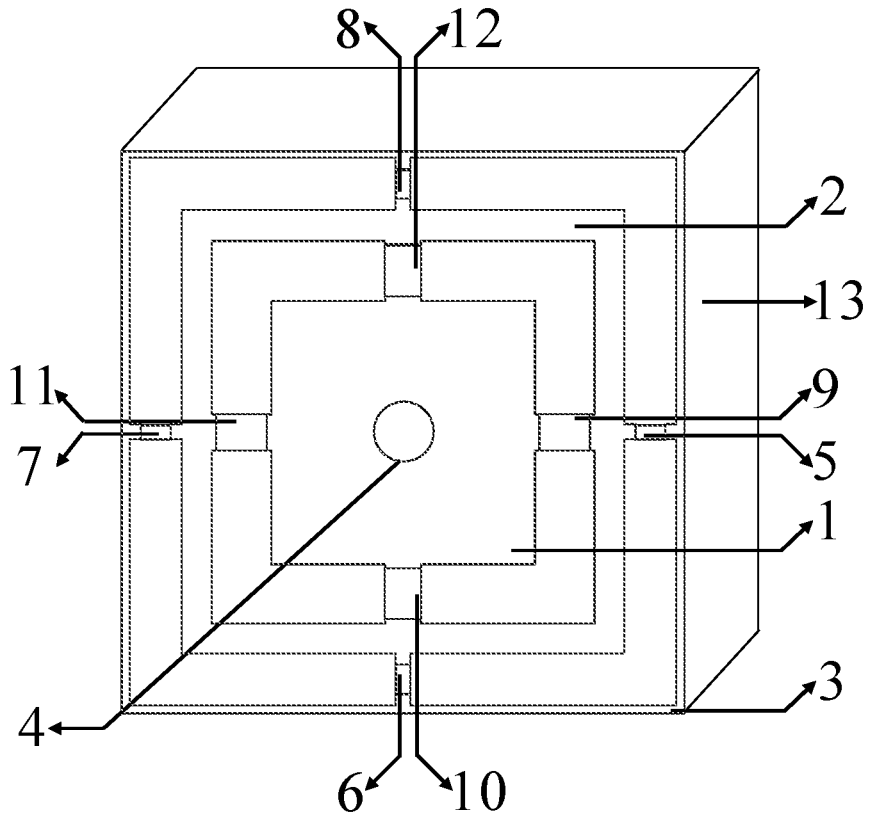
FIG. 2 is a three-dimensional schematic view of an AMC unit, according to some embodiments.

As shown in FIG. 1, a reconfigurable wideband PSS based on an AMC according to the present invention is composed of a plurality of centrally symmetric AMC units 15 with adjustable frequencies arranged in a two-dimensional periodic manner in the form of a square lattice. As shown in FIG. 2, the AMC unit 15 includes an upper metal patch, a middle dielectric substrate, a lower metal ground, a varactor group and a capacitor group.

The upper metal patch is composed of a central square metal patch 1, a first square ring metal patch 2 and a second square ring metal patch 3 and printed on the dielectric substrate 13, and a bottom surface of the dielectric substrate 13 is provided with the metal ground 14. The square metal patch is connected to the square ring metal patch by four varactors, the two square ring metal patches are connected by four capacitors, and both ends of the varactors and both ends of the capacitors are provided with metal patches.

The varactor group is composed of a first varactor 5, a second varactor 6, a third varactor 7 and a fourth varactor 8, which are coupled to, for example, welded on, a right side, a lower side, a left side and an upper side between the square metal patch 1 and the first square ring metal patch 2 respectively; and the capacitor group is composed of a first capacitor 9, a second capacitor 10, a third capacitor 11 and a fourth capacitor 12, which are coupled to, for example, welded on, a right side, a lower side, a left side and an upper side between the first square ring metal patch 2 and the second square ring metal patch 3 respectively and are all positioned on the dielectric substrate 13.

A sum of a length of the central square metal patch 1 vertically projected under the AMC unit 15, a length of the first square ring metal patch 2 vertically projected under the AMC unit 15, a length of the second square ring metal patch 3 vertically projected under the AMC unit 15 and lengths of the varactors 5 and 7, and lengths of the capacitors 9 and 11 (including a reserved welding length) is equal to a vertical projection length of the AMC unit 15.

Figure 3:
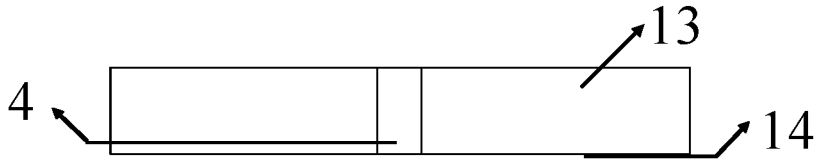
FIG. 3 is a side view of the AMC unit of FIG. 2.

As shown in FIG. 3, through a metalized through-hole 4 in the central position of the unit, the central square metal patch 1 is connected to the metal ground 14 at the bottom surface of the dielectric substrate via the metalized through-hole 4, so that the central square metal patches of units of periodically arranged AMCs are connected with each other. The metalized through-hole 4 passes through the dielectric substrate 13 and has a radius of one third of the total thickness of the dielectric substrate 13. The second square ring metal patches of units of periodically arranged AMCs are connected with each other.

In order to facilitate power feeding, a second square ring metal patch is added to a round of the entire upper surface, and a capacitor is added between the external second square ring metal patch and the internal first square ring metal patch in order to increase the gap capacitance and reduce the resonance frequency.

The perimeter of the square metal patch 1 is $\lambda_{eff}/2$, where $\lambda_{eff}=\lambda_0(\varepsilon_r+1)\hat{}0.5$, and $\lambda_0$ is a wavelength of a free space. The dielectric substrate 13 has a dielectric constant $\varepsilon_r$ of 2.2-10.2 and a thickness of 3 mm, about $0.05*\lambda_g$, where $\lambda_g=\lambda_0/\varepsilon_r\hat{}0.5$, and $\lambda_0$ is a wavelength of a free space. When the dielectric wavelength is calculated, a first resonant point selected is at 2.46 GHz.

The models of the first varactor 5, the second varactor 6, the third varactor 7 and the fourth varactor 8 are not unique, but it is necessary to select varactors capable of operating at a required radio frequency band or above. The models of the first capacitor 9, the second capacitor 10, the third capacitor 11 and the fourth capacitor 12 are not unique, but it is necessary to select capacitors capable of operating at a required radio frequency band or above.

Figure 4:
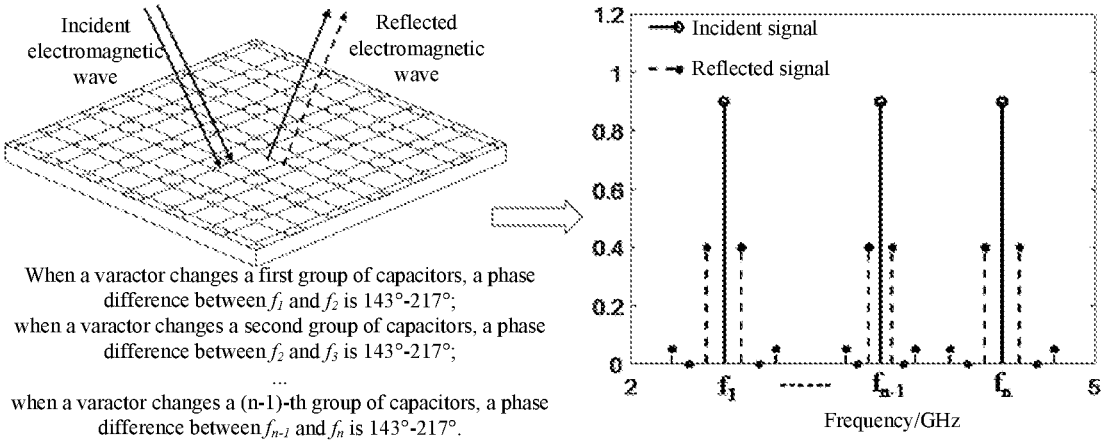
FIG. 4 is a schematic view of the working principle of the PSS, according to some embodiments.

As shown in FIG. 4, capacitance of varactors on the AMC is controlled, so that incident electromagnetic waves are respectively in an anti-phase reflection state and an in-phase reflection state at different frequencies, and the center frequency can be continuously switched to implement the broadband PSS with a relative bandwidth of 45% or above.

The four varactors are added to joints of the square metal patch and the square ring metal patch respectively, and the distribution of currents between gaps can be changed by changing the capacitance of the varactors, thus realizing various working modes. The gap between the square patch and the square ring patch is equivalent to capacitance. When the capacitance of the varactor is changed, it is equivalent to changing the gap capacitance, which can form a plurality of continuous frequency points, such that in-phase reflection and anti-phase reflection of incident waves can be switched in a wide frequency range.

The position of an in-phase reflection point of the AMC is changed by controlling the capacitance of the varactor, so that a phase difference between two connected frequency bands is 143°-217°, thereby realizing the effect of stealth to radar. For example, as shown in FIG. 4, when a varactor changes a first group of capacitors of an AMC, a phase difference between two frequencies ($f_1$, $f_2$) is 143°-217°. Similarly, when a varactor changes a second group of capacitors of an AMC, a phase difference between two frequencies ($f_2$, $f_3$) is 143°-217°. Accordingly, when a varactor changes an (n+1)th group of capacitors, a phase difference between two frequencies ($f_{n-1}$, $f_n$) is 143°-217°.

The AMC according to the present invention can be used to construct the PSS, i.e., incident electromagnetic waves are absorbed in a plurality of continuous frequency bands by changing the capacitance of the varactor.

The details and working conditions of a specific device according to the present invention will be described below.

Taking 8*8 units as an example, the AMC based on the frequency adjustable AMC units 15 has interface dimensions of 150 mm*150 mm and a total thickness of 3 mm, the dielectric substrate is made of material FR4 and has a dielectric constant of 4.4, and the metal ground 14 is cladded copper.

The centrally symmetric square metal patch 1 is a square with a side length of 8.8 mm; the metalized through-hole has a radius of 1 mm; the first square ring metal patch 2 is composed of four rectangular patches with a size of 1 mm*13.8 mm; the second square ring metal patch 3 is composed of four rectangular patches with a size of 0.25 mm*18.55 mm; a gap between the square patch and the first square ring patch is 2 mm; a gap between the first square ring patch and the second square ring patch is 2 mm; the varactor has a model of SMV1231-079 and a size of 1.2 mm*1.7 mm; and the capacitor has a capacitance of 0.5 pF and a size of 0.5 mm*1 mm.

Figure 5:
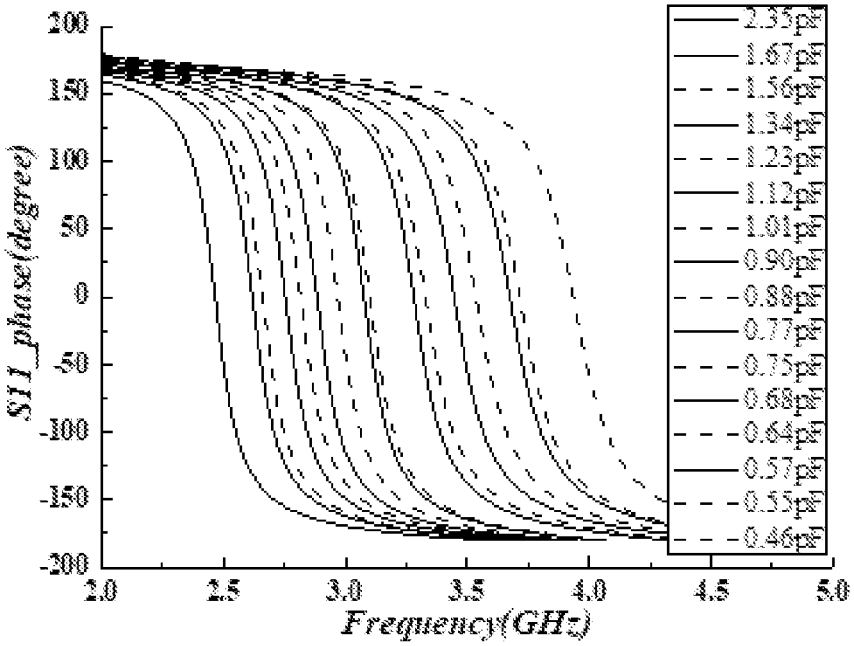
FIG. 5 is a phase curve graph of a reflection coefficient of the PSS when varactors are at different capacitance values.

As shown in FIG. 5, upon numerical calculation, it can be seen that the varactor has a capacitance of 2.35 pf when a reverse bias voltage is about 0 V, and a corresponding center frequency is 2.65 GHz; the varactor has a capacitance of 1.56 pf when the reverse bias voltage is about 1 V, and a corresponding center frequency is 2.46 GHz. The phase difference between the two frequency bands satisfies the foregoing conditions, such that the formed PSS absorbs incident waves in the frequency band of 2.48-2.65 GHz. The varactor has a capacitance of 1.67 pf when the reverse bias voltage is about 0.7 V, and a corresponding center frequency is 2.61 GHz; the varactor has a capacitance of 1.23 pf when the reverse bias voltage is about 2 V, and a corresponding center frequency is 2.81 GHz. The phase difference between the two frequency bands satisfies the foregoing conditions, such that the formed PSS absorbs incident waves in the frequency band of 2.63-2.81 GHz. The varactor has a capacitance of 1.34 pf when the reverse bias voltage is about 1.4 V, and a corresponding center frequency is 2.75 GHz; the varactor has a capacitance of 1.01 pf when the reverse bias voltage is about 2.6 V, and a corresponding center frequency is 2.96 GHz. The phase difference between the two frequency bands satisfies the foregoing conditions, such that the formed PSS absorbs incident waves in the frequency band of 2.76-2.96 GHz. The varactor has a capacitance of 1.12 pf when the reverse bias voltage is about 2.3 V, and a corresponding center frequency is 2.88 GHz; the varactor has a capacitance of 0.88 pf when the reverse bias voltage is about 3.5 V, and a corresponding center frequency is 3.09 GHz. The phase difference between the two frequency bands satisfies the foregoing conditions, such that the formed PSS absorbs incident waves in the frequency band of 2.9-3.1 GHz. The varactor has a capacitance of 0.9 pf when the reverse bias voltage is about 3.3 V, and a corresponding center frequency is 3.05 Hz; the varactor has a capacitance of 0.75 pf when the reverse bias voltage is about 4.3 V, and a corresponding center frequency is 3.32 GHz. The phase difference between the two frequency bands satisfies the foregoing conditions, such that the formed PSS absorbs incident waves in the frequency band of 3.09-3.33 GHz. The varactor has a capacitance of 0.77 pf when the reverse bias voltage is about 4.2 V, and a corresponding center frequency is 3.28 Hz; the varactor has a capacitance of 0.64 pf when the reverse bias voltage is about 5.5 V, and a corresponding center frequency is 3.53 GHz. The phase difference between the two frequency bands satisfies the foregoing conditions, such that the formed PSS absorbs incident waves in the frequency band of 3.3-3.53 GHz. The varactor has a capacitance of 0.68 pf when the reverse bias voltage is about 5 V, and a corresponding center frequency is 3.44 Hz; the varactor has a capacitance of 0.55 pf when the reverse bias voltage is about 7.5 V, and a corresponding center frequency is 3.71 GHz. The phase difference between the two frequency bands satisfies the foregoing conditions, such that the formed PSS absorbs incident waves in the frequency band of 3.46-3.71 GHz. The varactor has a capacitance of 0.57 pf when the reverse bias voltage is about 7 V, and a corresponding center frequency is 3.67 Hz; the varactor has a capacitance of 0.46 pf when the reverse bias voltage is about 15 V, and a corresponding center frequency is 3.93 GHz. The phase difference between the two frequency bands satisfies the foregoing conditions, such that the formed PSS absorbs incident waves in the frequency band of 3.7-3.93 GHz. Therefore, the PSS absorbs the incident waves in the frequency band of 2.48-3.93 GHz, with a relative bandwidth of 45%. Each group of solid lines and dashed lines in the figure constitute two frequencies satisfying the above phase difference condition, and a gray area shown in the figure is the intersection area of the two frequency points. In addition, since the overall thickness is less than one-twentieth wavelength, which is 80% lower than the conventional one-quarter wavelength, the technical solution is very effective.

Figure 6:
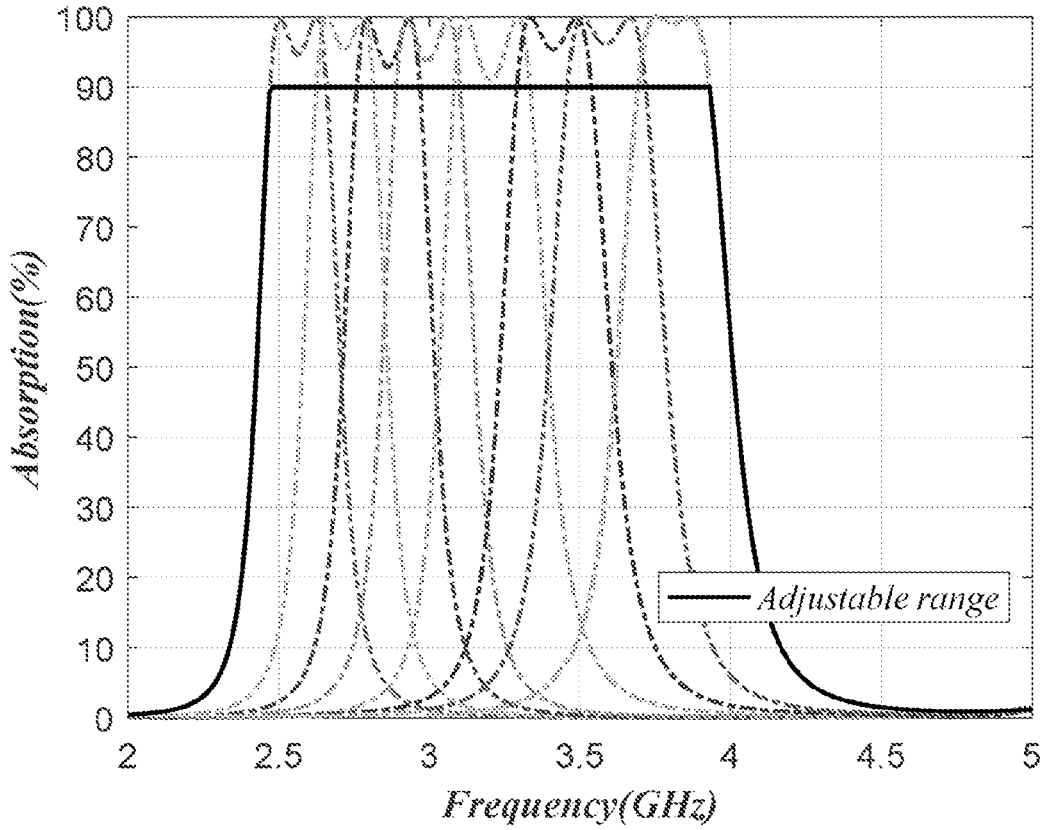
FIG. 6 is a curve graph of an absorption value of the PSS in each frequency band.

As shown in FIG. 6, upon numerical calculation, it can be seen that the foregoing absorptivity is 90% or above, and the frequency bands are crossed with each other, thus implementing the broadband PSS.

The above-described embodiments should be understood to serve only as illustrative examples; further embodiments are envisaged. Any feature described herein in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. An artificial magnetic conductor (AMC), comprising:

a plurality of centrally symmetrical AMC units arranged in a two-dimensional periodic manner, wherein each AMC unit of the plurality of centrally symmetrical AMC units comprises:

an upper metal patch;

a dielectric substrate;

a metal ground;

a varactor group comprising four varactors; and a capacitor group comprising four capacitors, wherein the upper metal patch comprises:

a central square metal patch;

a first square ring metal patch; and a second square ring metal patch, wherein:

at least a portion of the upper metal patch is printed on the dielectric substrate and a bottom surface of the dielectric substrate is provided with the metal ground;

the central square metal patch is connected to the first square ring metal patch by the four varactors of the varactor group;

the two square ring metal patches are connected by the four capacitors of the capacitor group; and both ends of each of the four varactors in the varactor group and both ends of each of the four capacitors in the capacitor group are provided with metal patches, and wherein the AMC unit further comprises:

a metalized through-hole in a central position of the AMC unit, wherein:

the central square metal patch is connected to the metal ground at the bottom surface of the dielectric substrate via the metalized through-hole;

the central square metal patches of units of periodically arranged AMCs are connected with each other; and the second square ring metal patches of units of periodically arranged AMCs are connected with each other.

2. The AMC according to claim 1, wherein the varactor group comprises:

a first varactor coupled to a right side of the AMC unit between the central square metal patch and the first square ring metal patch;

a second varactor coupled to a lower side of the AMC unit between the central square metal patch and the first square ring metal patch;

a third varactor coupled to a left side of the AMC unit between the central square metal patch and the first square ring metal patch; and a fourth varactor coupled to an upper side of the AMC unit between the central square metal patch and the first square ring metal patch, wherein the first through fourth varactors are positioned on the dielectric substrate, and wherein the capacitor group comprises:

a first capacitor coupled to a right side of the AMC unit between the first square ring metal square metal patch and the second square ring metal patch;

a second capacitor coupled to a lower side of the AMC unit between the first square ring metal square metal patch and the second square ring metal patch;

a third capacitor coupled to a left side of the AMC unit between the first square ring metal square metal patch and the second square ring metal patch; and a fourth capacitor coupled to an upper side of the AMC unit between the first square ring metal square metal patch and the second square ring metal patch, wherein the first through fourth capacitors are positioned on the dielectric substrate.

3. The AMC according to claim 2, wherein a sum of a length of the central square metal patch vertically projected under the AMC unit, a length of the first square ring metal patch vertically projected under the AMC unit, a length of the second square ring metal patch vertically projected under the AMC unit, a length of the first varactor and a length of the third varactor, and lengths of both the first capacitor and the third capacitor is equal to a vertical projection length of the AMC unit.

4. The AMC according to claim 1, wherein the perimeter of the central square metal patch is $\lambda_{eff}/2$, where $\lambda_{eff}=\lambda_0(\varepsilon_r+1)\hat{}0.5$, and $\lambda_0$ is a wavelength of a free space.

5. The AMC according to claim 1, wherein the dielectric substrate has a dielectric constant $\varepsilon_r$ of 2.2-10.2 and a thickness of $0.05*\lambda_g$, where $\lambda_g=\lambda_0/\varepsilon_r\hat{}0.5$, and $\lambda_0$ is a wavelength of a free space.

6. The AMC according to claim 1, wherein a reconfigurable wideband phase-switched screen (PSS) is constructed on the basis of the AMC, wherein a capacitance of varactors on the AMC is controlled so that incident electromagnetic waves are respectively in an anti-phase reflection state and an in-phase reflection state at different frequencies, and the center frequency is continuously switched to implement a broadband PSS of the reconfigurable wideband PSS.

7. The AMC according to claim 6, wherein a position of an in-phase reflection point of the AMC is changed by controlling the capacitance of the varactor, so that a periodic unit has a plurality of continuous frequency points, and the phase difference between two adjacent frequency bands is 143°-217°, thereby realizing the effect of stealth to radar.

8. A circuit, comprising:

a plurality of centrally symmetrical artificial magnetic conductor (AMC) units arranged in a two-dimensional periodic manner, wherein each AMC unit of the plurality of AMC units comprises:

an upper metal patch;

a dielectric substrate;

a metal ground;

a varactor group comprising four varactors; and a capacitor group comprising four capacitors, wherein the upper metal patch comprises:

a central square metal patch;

a first square ring metal patch; and a second square ring metal patch, and wherein:

at least a portion of the upper metal patch is printed on the dielectric substrate and a bottom surface of the dielectric substrate is provided with the metal ground;

the central square metal patch is connected to the first square ring metal patch by the four varactors of the varactor group; and the two square ring metal patches are connected by the four capacitors of the capacitor group.

9. The circuit of claim 8, further comprising:

a metalized through-hole in a central position of the AMC unit, wherein:

the central square metal patch is connected to the metal ground at the bottom surface of the dielectric substrate via the metalized through-hole;

the central square metal patches of units of periodically arranged AMCs are connected with each other; and the second square ring metal patches of units of periodically arranged AMCs are connected with each other.

* * * * *